United States Patent [19]

Yueh

[11] Patent Number: 4,934,648

[45] Date of Patent: Jun. 19, 1990

[54] PAPER HOLDER

[76] Inventor: Wu S. Yueh, 4th Floor, No. 20 Kuan Fu Road, Chung Ho City, Taipei Hsien, Taiwan

[21] Appl. No.: 304,517

[22] Filed: Jan. 31, 1989

[51] Int. Cl.[5] ..... A47H 1/10

[52] U.S. Cl. ..... 248/442.2; 248/918

[58] Field of Search ..... 248/442.2, 451, 475.1, 248/1 B; 211/45, 47, 48; 24/457; 312/233; 400/718

[56] References Cited

U.S. PATENT DOCUMENTS

| | | | |
|---|---|---|---|
| 1,615,959 | 2/1927 | Slavik | 248/442.2 |
| 3,207,319 | 9/1965 | Best | 211/48 |
| 4,197,026 | 4/1980 | Vorbach | 400/718 |
| 4,332,364 | 6/1982 | Beskin | 248/442.2 |
| 4,475,705 | 10/1984 | Henneberg | 248/451 |
| 4,582,285 | 4/1986 | Bello | 248/442.2 |
| 4,632,471 | 12/1986 | Visnapuu | 248/442.2 |
| 4,747,572 | 5/1988 | Weber | 248/442.2 |
| 4,767,093 | 8/1988 | Jones | 248/447.1 |
| 4,836,489 | 6/1989 | Chu | 248/442.2 |

FOREIGN PATENT DOCUMENTS

| | | | |
|---|---|---|---|
| 2433528 | 1/1976 | Fed. Rep. of Germany | 248/442.2 |

*Primary Examiner*—J. Franklin Foss

*Attorney, Agent, or Firm*—Baker & McKenzie

[57] ABSTRACT

A holder for single or multiple sheets of paper adapted to be affixed, permanently or demountably, to a computer monitor or other location where it is desired for paper to be held up in a manner that it can be viewed. The holder includes a plurality of arms having surfaces which define a non-planar path along which the paper may be inserted. The paper holder preferably is mounted to the desired surface by a base which permits the arms to be positioned so as to hold the paper along an edge thereof. The arms are preferably affixed to the base by means which permit the arms to be positioned to a convenient position for viewing the paper.

9 Claims, 1 Drawing Sheet

10
28
24
26
17
16
11
14
39
21
22
23
19
41
27
18
32
13
29
36

12
28
11
14
32
13
3
3
31
29
38
37
36

12
29
13
28
33
38
31
16
11
34
24

PAPER HOLDER

BRIEF DESCRIPTION OF THE INVENTION

Increasingly, computers, computer terminals and other such equipment is becoming an integral part of the office environment. While the improvements in speed and work product provided by the new equipment has proved useful, it frequently diminishes the workspace on the desk significantly.

Much office work requires reference to one or more sheets of paper which must be reviewed as the work progresses. A prime example of this is the function of word processing, in which revisions made to a document by hand or excerpts from other documents must be included in a document stored in the computer.

It is generally inconvenient to try to lay the document on the desk and work from it in that position. Inaccuracies result from the angle at which the document is presented, and it is difficult to look from the document on the desk to the computer screen and back as changes are made to the document displayed on the computer screen.

One prior art solution to this problem has been to place a document stand next to the monitor. Such stands frequently comprise a slanted backboard which is of the approximate size of a piece of paper. This backboard is mounted on a base, which frequently is almost the size of an average sheet of paper. The stands are frequently equipped with a clip or retainer of some kind to keep the paper from sliding or blowing off the stand. However, once a desk is equipped with a modern telephone, computer monitor, and computer keyboard, there is very little room left for such paper stands. The paper stands also give the desk a cluttered and obstructed appearance, which is detrimental to the sense of well-being of the operator. These paper stands, which are frequently made of lightweight material, are also frequently subject to being knocked off the desk. Further, the clips or other holding devices used on these devices generally require both hands to operate. This requires that the paper holder be brought very near the operator so that both hands may be conveniently employed.

Other prior art paper stands have tried to overcome some of these difficulties by providing heavy bases or articulated mounts which permit the backboard to be moved out of the way, but these remedies generally raise the cost of the holders significantly. Further, these holders frequently make the desk appear even more cluttered and are frequently in the way when the desk is needed for other activities.

Yet other paper holders are adapted for mounting to a monitor and may be swivelled out of the way, but involve springs for gripping the paper and may crease the paper or require two hands to operate.

These deficiencies of the prior art devices are overcome by the present invention. The present invention comprises a base which may be adapted for mounting to a computer monitor or other office equipment or to a wall or partition or the like. The base may be affixed to the computer monitor, etc. by any of a variety of known means such as screws, adhesives, vacuum mounting devices, and magnetic pads, and may be of two parts such that the main portion of the paper holder can be removed for storage when desired.

The device of the present invention also includes a plurality of arms which extend generally parallel to one another for holding the paper. The arms are mounted to the base by means of an articulated mounting which permits the arms to be pivoted into a position to hold one or more sheets of paper along an edge thereof. If the base is mounted to the side or top of a computer monitor, the paper holder of the present invention may be configured such that the arms are positionable to hold the paper beside the monitor screen generally in a plane which is approximately coplanar with the monitor screen. In such configuration, the mounting may also hold the arms such that they may be positioned above or along side the monitor housing when not in use and can be positioned to extend generally toward the operator for easy loading of paper into the paper holder.

The proximate surfaces of the arms define a non-planar paper channel into which sheets of paper may be inserted. The arms are configured and disposed such that the paper must be deformed from its planar state when inserted in the paper channel. For example, in one configuration of the present invention, the plurality of arms may be a pair of generally parallel arms the facing portions of which form a "V" shaped paper channel. The convex "V" shaped surface of one of the arms extends into the concave "V" shaped recess in the other arm, such that when the upper edge of a sheet of paper is inserted into the paper channel, it is deformed from its planar state to conform to the "V" shape of the paper channel. The paper channel could, of course, take any of a variety of shapes, such as being "W" or "S" shaped. The deforming of the paper contributes to the holding power of the apparatus such that it is not necessary for the arms to press against one another. Thus, the insertion of the paper into the paper channel does not have to result in a creasing of the paper, as frequently occurs with paper holders which rely on spring-loaded clips. In fact, with respect to the "V" shaped paper channel as discussed above, the arms may be spaced relatively far apart as compared to the thickness of a sheet of paper without compromising the paper-holding ability of the device. The arms may also be configured such that they diverge from one another at the ends thereof which are remote from the mounting so that paper may be easily loaded into the holder with one hand.

The present invention thus provides an economical paper holder for holding single or multiple sheets of paper for viewing by an operator and which may be configured to be positionable by the user to a convenient location for viewing or loading of the paper, and can be retracted to a position in which it is out of the way. Since the paper holder of the present invention does not require a backboard for the paper, it can be small and unobtrusive as compared to the prior art devices described above. Preferably, the holder is configured so that it can also be retracted to a position in which it is out of the way when not in use.

Since a paper holder according to the present invention can be configured to mount on a computer monitor and retract to a position above the monitor, it does not require any additional desk space and does not give the desk a cluttered appearance. A paper holder according to the present invention can also be configured such that it is easy to load and remove paper with only one hand and such that it holds the paper without creasing or otherwise marring it.

DETAILED DESCRIPTION OF THE PREFERRED EMBODIMENT

Figures 1, 2, 3:
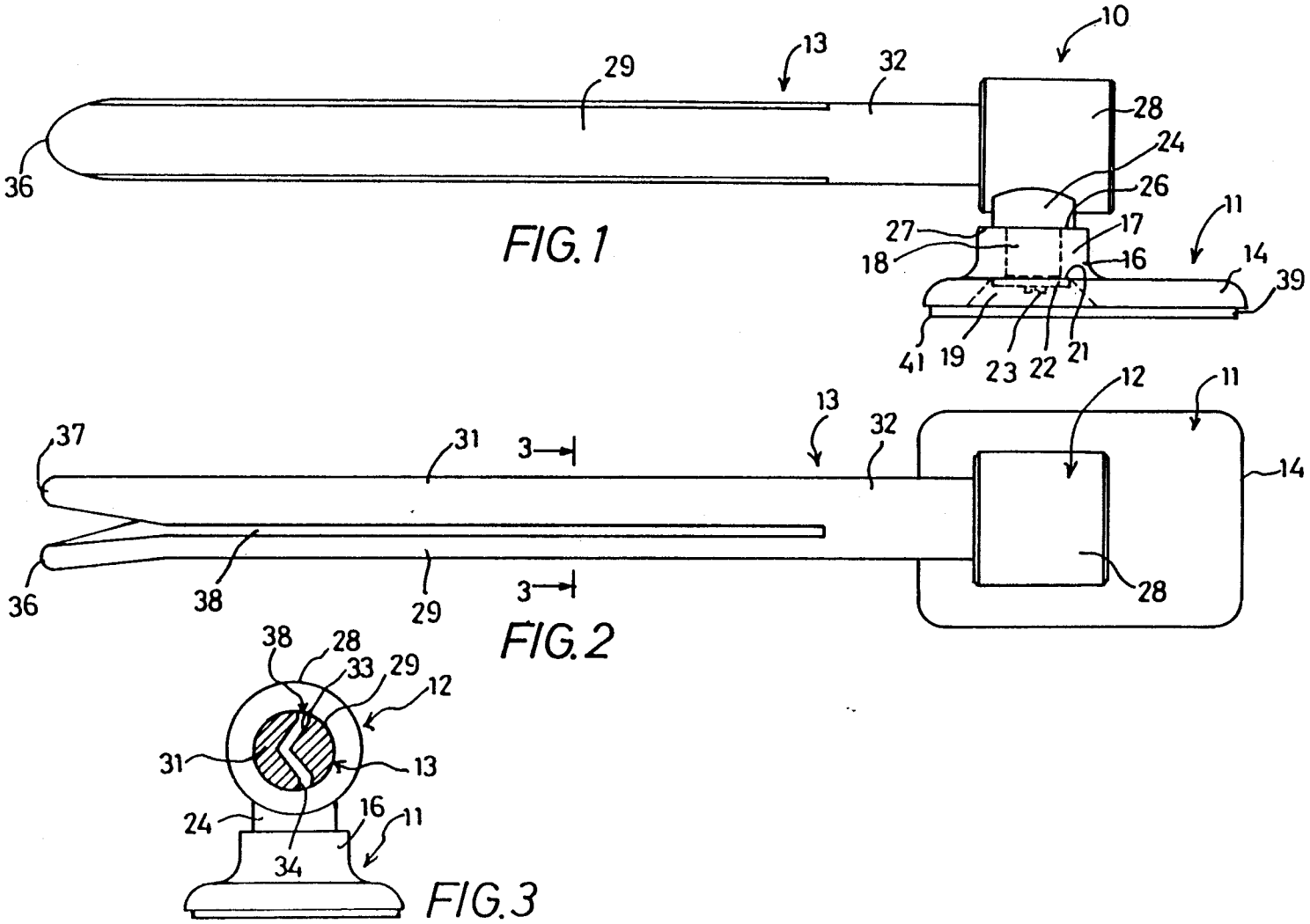
FIG. 1 is a side elevation of a paper holding device according to the present invention with certain hidden details shown in broken lines.
FIG. 2 is a top plan view of a paper holding device according to the present invention with certain hidden details shown in broken lines.
FIG. 3 is a cross-sectional view of a paper holding device according to the present invention taken at the line 3—3 in FIG. 1.

The paper holding device of the preferred embodiment comprises a base portion 11 which supports a pivotable mounting 12. An elongated paper support is connected to the pivotable mounting 12.

As shown in FIG. 1, the base comprises a generally planar lower section 14 which is adapted to conform to the generally planar surface of office equipment such as computer monitors. A generally cylindrical neck 16 having a cylindrical bore 17 along its axis extends upwardly from the lower section 14 of the base 11 to receive the lower cylindrical section 18 of the pivotable mounting 12. The cylindrical bore 17 in the neck 16 is of sufficient diameter with respect to the lower cylindrical section 18 that the lower cylindrical section 18 can rotate therein A frustoconical aperture 19 is formed in the lower section 14 of the base 11. The cylindrical bore 17 opens into the frustoconical aperture 19 and is coaxial therewith. The frustoconical aperture 19 has a minimum diameter which is greater than that of the cylindrical bore 17, thus forming a shoulder 21 about the periphery of the cylindrical bore 17. A washer 22, which has a diameter greater than that of the cylindrical bore 17 but less than the minimum diameter of the frustoconical aperture 19 is secured to the bottom of the lower cylindrical section 18 of the pivotable mounting 12 by means of a screw 23, thus preventing the cylindrical lower section 18 of the pivotable mounting 12 from moving upwardly out of the cylindrical bore.

The lower cylindrical section 17 of the pivotable mounting 12 extends downwardly from the medial portion 24 of the pivotable mounting 12. This medial portion 24 is of greater diameter than the cylindrical lower section and thus forms a shoulder 26 which abuts the upper surface 27 of the neck 16 of the base 11 when the lower cylindrical section 18 of the pivotable mounting 12 is fully inserted into the cylindrical bore 17 of the neck 16.

The upper portion 28 of the pivotable mounting 12 is affixed to and may be formed integrally with the medial portion 24 and lower cylindrical portion 18 of the pivotable mounting 12. The elongated paper support 13 extends outwardly from the upper portion 28 of the pivotable mounting 12 and may be formed integrally therewith, for example by molding.

The paper support 13 comprises first and second arms 29, 31 for receiving one or more sheets of paper which extend outwardly from an extension section 32 of the elongated paper support. The extension section 32, in turn, is mounted on the upper portion 28 of the pivotable mounting 12.

As best illustrated in FIGS. 2 and 3, the facing surfaces 33, 34 of the first and second arms 29, 31 of the paper support 13 are respectively convex and concave and are generally parallel to one another, except over the distal end portions 36, 37 thereof as explained below. The facing surfaces are spaced apart from one another to form a generally "V" shaped paper channel 38 with the convex facing surface 33 of the second arm 31 extending into the concave facing surface 34 of the first arm such that a piece of paper must be deformed from its generally planar state in order to be inserted in the paper channel 38. The minimum distance between the facing sides 33, 34 of the arms 29, 31 along the paper path is significantly greater than the thickness of a single sheet of paper.

Although the facing surfaces 33, 34 of the arms 29, 31 are generally parallel to one another along their lengths, the facing surfaces 33, 34 diverge from one another and become relatively more nearly planar over the distal end portions 36, 37 of the arms 29, 31. The facing surfaces 33, 34 diverge sufficiently from one another over the distal end sections 36, 37 that a planar piece of paper can be inserted a short distance between the distal end portions 36, 37 of the first and second arms 29, 31 before it commences to be deformed from its planar state by engagement with the portions of the facing surface 33, 34 which are generally parallel to one another.

The base 11 of the paper holder device may be secured in place to a surface such as the upper surface of a computer monitor by a variety of means. One preferred means is a layer of conventional adhesive backed foam mounting tape 39 which comprises a thin layer of a compliant foam material coated on both sides with adhesive. This tape may be applied to the lower surface of the base 11. The lower surface of this adhesive foam mounting tape 39 may in turn be covered with a sheet of release paper 41 which may be removed prior to installation.

In use, the preferred embodiment of the paper holder as described above is adapted for mounting on a generally horizontal planar surface such as the upper surface of a computer monitor. It will be noted from FIG. 1 that the neck 16 of the base 11 is offset to one side of the lower section 14 of the base 11. For mounting purposes, the side of the lower section 14 which is remote from the neck 16 should be aligned with the elongated paper holder 13 such that it is on opposite sides of the neck 16 from the elongated paper holder 13 when the elongated paper holder 13 is pivoted into position in which papers will be viewed by the user.

When the paper holder of the present embodiment is not in use, the pivotable mounting 12 may be swiveled relative to the base 11 such that the elongated paper holder 13 is in a convenient position for the user. For example, if the base is mounted on the upper left corner of a generally cubical computer monitor adjacent the front of the monitor, the elongated paper holder 13 may be positioned such that it extends outward from the computer monitor to the left thereof in a plane generally parallel to the screen for holding a paper to be used. When not in use, the pivotable mounting may be rotated to position the elongated paper support generally parallel to the upper left hand edge of the computer monitor, a position in which it will not generally interfere with the use of the desk. For loading of the paper, the pivotable mounting 12 can be rotated to position the elongated paper holder 13 such that it extends generally in the direction of the user. In such position, the user will not be required to reach forward as far to insert one or more sheets of paper into the elongated paper support 13.

The divergence of the facing surfaces 33, 34 of the distal end portions 36, 37 of the arms 29, 31 is provided to facilitate the insertion of paper into the elongated paper support 13. In practice, a sheet of paper may be inserted into the elongated paper support 13 by aligning the upper edge thereof generally parallel to the elongated paper support 13 and moving it along the axis of the elongated paper support toward the pivotable mounting. As the paper enters the portion of the paper channel 38 in which the convex facing surface 33 of the arm 29 extends into the concave facing surface 34 of the second arm 31, the paper is deformed from its planar state.

As mentioned above, the distance between the facing surfaces 33, 34 of the arms 29, 31 which define the paper channel is greater than the thickness of a single sheet of paper. As such, paper may be inserted into the paper channel without conforming strictly to either the convex shape of the facing surface 33 or the concave surface of the facing surface 34 of the arms 29, 31. Rather, the paper may contact the facing surface at only certain locations such as at the protruding edge of the "V" shaped convex surface of the facing surface 33 and along the outer edges of the concave "V" shaped facing surface 34 of the facing surface 34. In this manner, the paper may be deformed to form a generally smooth curve through the paper channel 38 and thus needs not be creased or marked by its insertion into the paper channel 38.

If desired, it will be appreciated by those skilled in the art that the paper holder of the present invention may be adapted within the scope of the invention for mounting to surfaces other than vertical surfaces by mounting the neck 16 to the lower portion 14 of the base 11 at an angle such that the pivotable mounting 12 can be rotated to position the elongated paper holder 13 in the desired orientations. The lower surface of the base 11 could also be adapted to conform to non-planar surfaces, and other mounting means such as conventional magnetic means, vacuum bases, or screws could be used to secure the base 11 in place.

Other such modifications to the preferred embodiment of the invention could also be made all within the scope of the invention. The preferred embodiment is thus to be taken as illustrating the invention, and the scope of the invention shall be determined in accordance with the claims hereof.

I claim:

1. A device for holding semi-rigid sheets of material without wrinkling or creasing said sheets comprising:

means forming a plurality of generally parallel arms, said arms defining a path therebetween for receiving a sheet of semi-rigid material, said arms being configured and disposed relative to one another such that a sheet of material must be deformed from a planar state along a generally linear strip thereof uniformly along said strip while it is in said path, said arms being spaced apart from one another along their length by a distance which is greater than the thickness of the semi-rigid material to be held thereby, whereby a piece of material inserted into said path is deformed out of the plane of the remainder of the material along said strip to conform generally to the shape of said path; and means for retaining said arms in said configuration and disposition relative to one another.

2. The holding device of claim 1 wherein said means for retaining said arms comprises means forming a base and an articulated mounting means whereby said means forming a plurality of arms may be pivoted relative to said means forming a base.

3. The holding device of claim 2 wherein said means forming a plurality of arms comprises at least two arms, one of said arms having at least one convex portion and the second of said arms having at least one concave portion, the arms being so disposed that said at least one convex portion is aligned with and extend inwardly toward said at least one convex portion.

4. The holding device of claim 2 wherein said means forming a plurality of arms comprises two arms, each said arm having a facing surface wherein the facing surface of one arm includes a concave channel extending generally parallel to the axis thereof and wherein the facing surface of the other arm includes at least one convex portion which extends inwardly of said channel, said facing surfaces forming said path therebetween.

5. The holding device of claim 4 wherein said convex portion conforms generally to the shape of said convex channel such that the facing surfaces of said arms conform generally to one another.

6. The holding device of claim 4 wherein the facing surfaces of said two arms diverge from one another at the ends thereof which are remote from said means for retaining said arms.

7. A paper holding device for holding one or more sheets of paper without wrinkling or creasing said paper comprising:

at least two arms disposed generally parallel to one another and each such arm having a surface spaced apart from the facing surface of the other such arm, said facing surfaces defining a paper path therebetween, said facing surfaces conforming generally to one another, one of said facing surfaces being in the form of a concave channel, said channel running generally parallel to the longitudinal axis of the arm, the other of said facing surfaces being convex and having a shape which corresponds generally to the convex channel in the facing arm, said convex portion extending into the concave channel in said other arm, said facing surfaces being generally equally spaced from one another along a major portion of their length by a distance which is greater than the thickness of the paper to be held, whereby a piece of paper inserted into said paper path is deformed out of the plane of said paper in a generally uniform manner along only a strip thereof to conform generally to the shape of said paper path;

mounting means for maintaining said arms in their relative dispositions; and base means pivotably connected to said mounting means such that said arms can be moved through a range of angles relative to said base means.

8. The paper holding device of claim 7 wherein said paper path comprises a generally "V" shaped paper path and wherein said facing surfaces diverge from one another adjacent the ends thereof whereby the insertion of paper into the paper path is facilitated.

9. The paper holding device of claim 8 wherein the pivotable connection between the base means and the mounting means constrains the pivoting of said mounting means to a single plane and wherein said base is adapted to support said mounting means such that the plane of movement of said arms is generally perpendicular to the force of gravity.

* * * * *